US008744328B2

(12) United States Patent
Fromm et al.

(10) Patent No.: US 8,744,328 B2
(45) Date of Patent: Jun. 3, 2014

(54) METHODS AND SYSTEMS FOR ESTABLISHING STEADY STATE ADJUSTED RELEASE FLUID RATE BEFORE SHEET PROCESSING AT A FUSING NIP

(75) Inventors: Paul M. Fromm, Rochester, NY (US); David Mark Kerxhalli, Rochester, NY (US); Benjamin Whitney Paulson, Webster, NY (US); Aldwin A. Roberts, Macedon, NY (US); Michele Donna Cleary, Rochester, NY (US); David Lee Rasmussen, Fairport, NY (US); Biruk Gossaye, Rochester, NY (US); Jamison Charles DeLorenzo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 293 days.

(21) Appl. No.: 13/284,392

(22) Filed: Oct. 28, 2011

(65) Prior Publication Data

US 2013/0104990 A1 May 2, 2013

(51) Int. Cl.
*G03G 15/20* (2006.01)

(52) U.S. Cl.
USPC ..... 399/325

(58) Field of Classification Search
USPC ..... 399/237, 325, 324
See application file for complete search history.

(56) References Cited

U.S. PATENT DOCUMENTS

| | | | | |
|---|---|---|---|---|
| 8,265,533 | B2 * | 9/2012 | Barton et al. | 399/325 |
| 2002/0044805 | A1 * | 4/2002 | Hasegawa | 399/325 |
| 2002/0094218 | A1 * | 7/2002 | Fujita et al. | 399/325 |
| 2003/0095806 | A1 * | 5/2003 | Wu et al. | 399/45 |
| 2010/0079560 | A1 | 4/2010 | Derimiggio et al. | |

OTHER PUBLICATIONS

Augusto E. Barton et al.; Fuser Release Fluid Rate Transient Control Via Variable Speed Oil Metering System; U.S. Appl. No. 12/822,399; filed Jun. 24, 2010.

* cited by examiner

*Primary Examiner* — Walter L Lindsay, Jr.
*Assistant Examiner* — Rodney Bonnette
(74) *Attorney, Agent, or Firm* — Ronald E. Prass, Jr.; Prass LLP

(57) ABSTRACT

A fluid delivery system is controlled to adjust a release fluid delivery rate to a rate that is predetermined to be effective for fusing a next sheet in a print job before the sheet arrives at a fusing nip. Predetermined rates and corresponding media types may be stored in memory. A controller controls the fluid release system for a print job in accordance with a print job schedule based on the predetermined fluid delivery rates.

16 Claims, 4 Drawing Sheets

METHODS AND SYSTEMS FOR ESTABLISHING STEADY STATE ADJUSTED RELEASE FLUID RATE BEFORE SHEET PROCESSING AT A FUSING NIP

FIELD OF DISCLOSURE

The disclosure relates to methods, apparatus, and systems for setting or adjusting a rate at which release fluid is delivered to a fuser member or spreader member in a printing system. In particular, the disclosure relates to methods, apparatus, and systems for adjusting a release fluid rate for a fuser member to a rate that is suitable for a particular media type or page end user requirement before a sheet of that media type or page contacts the fusing member.

BACKGROUND

A release fluid delivery rate is an important parameter to consider for print jobs using a printing system such as, e.g., a ink jet printing system or xerographic printing system. For example, fluid applicators may be designed to supply release fluid such as, for example, silicone oil to a fuser member, at a nominal rate. The nominal rate may not be easily adjusted. Such systems are vulnerable to release fluid variability due to system component variations and wear, as well as demands introduced by various media types.

A given media and/or job type may have a corresponding optimum fluid release rate. For fixed rate release fluid delivery systems, the rate must be chosen so that the most demanding requirements within a print job are met. Consequently, for a print job having multiple media types of varying demands, for example, the least demanding media types nonetheless receive release fluid at a rate suitable for the most demanding media types. Excess release fluid may cause prints to become oily, and/or objects to fail to stick to paper, and/or excess release fluid spreading to other components of the printing system such as in duplexing operations. Too little release fluid may degrade image quality and increase a difficulty of removing the sheet from a fusing member, such as a fuser roll that defines a fusing nip with a backing member. Too little release fluid may shorten the life of fusing and/or spreading rolls.

A release fluid metering rate may be adjusted as appropriate for particular media types and/or print job demands. For example, related art systems include ink jet printing systems and xerographic printing systems as described in "Variable Fuser Release Fluid Application" (U.S. application Ser. No. 12/243,380) to Derimiggio et al. Such systems accommodate metering release fluid onto a fuser roll surface at various rates depending on a surface velocity of a fluid film metering roll, and at least one of an amount of fluid film left on a the donor roll, a film thickness of the fluid film on the fluid film metering roll, and a speed ratio between the fluid film metering roll and the donor roll. A variable speed drive operably connected to the metering roll may be used to adjust the release fluid metering rate according to particular print job requirements. A closed loop oil rate control system as disclosed in "Passive IR Oil Rate Sensor" (U.S. application Ser. No. 12/352,136) to Dermiggio may be used to adjust a release metering rate toward a desired metering rate by, e.g., monitoring release film thickness using an IR sensor and connected controller.

SUMMARY

A release fluid delivery system in accordance with embodiments may configured to prepare a release fluid rate before the sheet arrives at a fusing nip because a desired or target release fluid rate with corresponding film coverage of a fuser member and or the sheet cannot be arrived at instantaneously.

In an embodiment, methods may include establishing a steady-state fuser release fluid delivery rate for processing a sheet at a fusing nip, the steady-state fluid delivery rate being established before the sheet is fused at the fusing nip by adjusting a current fluid delivery rate to match a target fluid delivery rate; and fusing the sheet at the fusing nip at the current fluid delivery rate matching the target fluid delivery rate. Methods may include receiving a predetermined target release fluid delivery rate for a first sheet. Methods may include determining whether the current fluid delivery rate matches the target fluid delivery rate.

In an embodiment, methods for establishing a steady-state fuser release fluid delivery rate for processing a sheet at a fusing nip, the steady-state fluid delivery rate being established before the sheet is fused at the fusing nip, may include metering a release fluid onto a fuser roll according to a predetermined fluid delivery rate before a sheet enters the fusing nip. Methods may include receiving the predetermined release fluid delivery rate, the predetermined release fluid delivery rate corresponding to the sheet. The predetermined release fluid delivery rate being stored as data in a look-up table format, the data including predetermined release fluid delivery rates and corresponding sheet types.

In an embodiment, methods for establishing a steady-state fuser release fluid delivery rate for processing sheets a fusing nip for a print job may include metering release fluid onto a fuser member at a first release fluid delivery rate before a first sheet is contacted by the fuser member. Methods may include fusing the first sheet at the fusing nip while metering release fluid onto the fuser member at the first rate. Methods may include metering the release fluid onto the fuser member at least two fuser member revolutions before the first sheet enters the fusing nip. Methods may include metering release fluid onto a fuser member at a second release fluid delivery rate before a second sheet is contacted by the fuser member. Methods may include fusing the second sheet at the fusing nip while metering release fluid onto the fuser member at the second release fluid rate.

In an embodiment, methods may include receiving a first release fluid delivery rate corresponding to a first sheet type; and receiving a second release fluid delivery rate corresponding to a second sheet type. The first rate and the second rate may be stored in a relational database, wherein the first rate is a predetermined rate that corresponds to the first sheet type, and the second rate is a predetermined rate that corresponds to a second sheet type. The first sheet may be a first sheet type and the second sheet may be a second sheet type. For example, the first sheet type may be paper of at least one of a first weight and a first thickness, and the second sheet type may be paper of at least one of a second weight and second thickness. The release fluid may be, for example, silicone oil.

In an embodiment, a first sheet type may include a coating that differs from a coating of a second sheet. For example, a first sheet type may include a suitable coating now known or later developed, and a second sheet type may include no coating. The first sheet type may have a different gloss level than a second sheet type, for example. In an embodiment, a first sheet type may be processed at a given position in a print job that is different than a position at which a second sheet type in the print job is processed. For example, where a print job includes printing a book having a cover, a first sheet type may include material suitable for forming a book cover, and a second sheet type may be suitable for constituting pages of the book.

In an embodiment, systems for establishing a steady state release fluid delivery rate for delivering fluid from a release fluid delivery system to a fuser member may include a release fluid delivery system for delivering release fluid to a fuser member, a rate of fluid delivery from the delivery system to the fuser member being adjustable; and a controller for adjusting the rate of fluid delivery to a predetermined rate, the predetermined rate corresponding to a next sheet to be contacted by the fusing member, the controller adjusting the rate to the predetermined rate before the sheet is contacted by the fuser member.

Exemplary embodiments are described herein. It is envisioned, however, that any systems that incorporate features of methods and systems described herein are encompassed by the scope and spirit of the exemplary embodiments.

DETAILED DESCRIPTION

Figure 1:
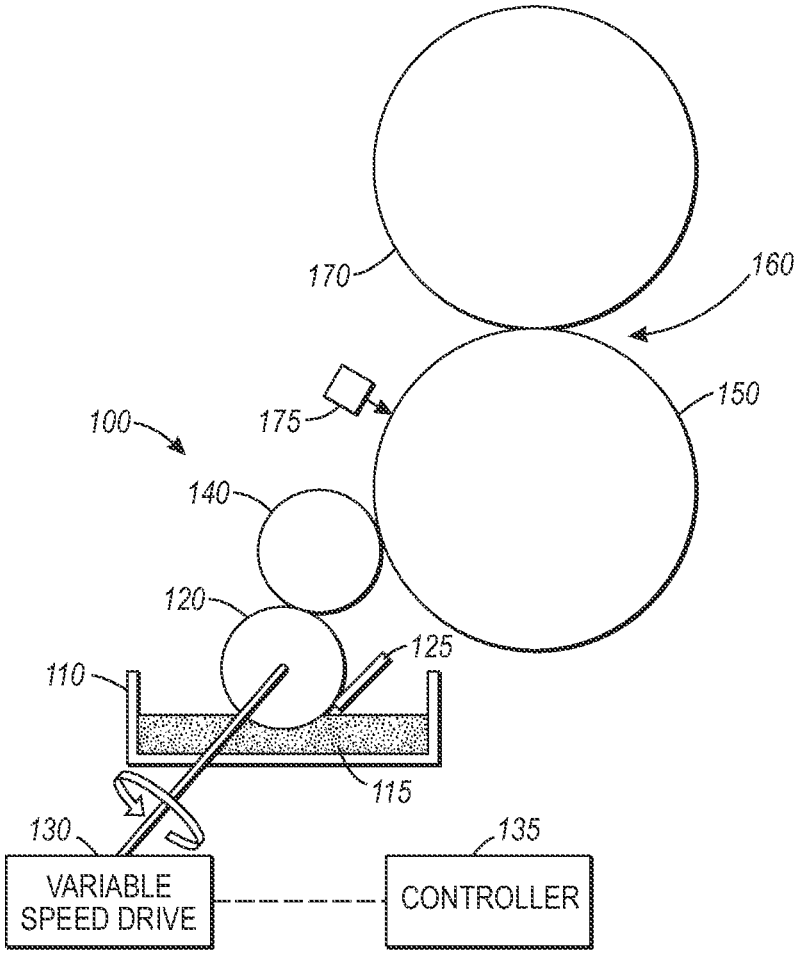
FIG. 1 shows a diagrammatical side view of a fluid delivery system in accordance with an exemplary embodiment.

Exemplary embodiments are intended to cover all alternatives, modifications, and equivalents as may be included within the spirit and scope of the methods and systems as described herein.

Reference is made to the drawings to accommodate understanding of methods and systems for adjusting a release fluid delivery rate for a release fluid delivery system of a printing system. In the drawings, like reference numerals are used throughout to designate similar or identical elements. The drawings depict various embodiments of illustrative methods and systems for adjusting a release fluid rate to a rate appropriate for a sheet to be fused during a print job before a fuser member serviced by the fluid delivery system contacts the sheet.

If a release fluid metering rate is adjusted when the sheet arrives at a fuser roll that is associated with a release fluid delivery system, the oil coverage on the fuser roll and sheet could be ineffective and/or undesirable. A release fluid delivery system in accordance with embodiments may be configured to establish a release fluid rate before the sheet arrives. The release fluid rate and corresponding film coverage cannot be arrived at instantaneously. Methods and systems of embodiments accommodate reduced print defects, improved release fluid rate adjusting during a print job, and improved post-processing of prints, including binding laminating, and overcoating.

Systems may include a release fluid delivery system that is connected to a controller for controlling the system to modify a rate of release fluid delivery. The release fluid may be a release agent, a lubricant, an ink, a thin film, oil such as silicone oil, or any other suitable fluid. A suitable release fluid minimizes, e.g., toner offset on a print assembly, and can provide for separation of media from the fuser components such as the fuser roll.

The release fluid delivery system may be associated with a fuser apparatus. The fuser apparatus may include a fuser roll onto which release fluid is metered to form a film. As fluid is delivered to a surface of the fuser roll. After a rate adjustment the delivery rate may be transient. After about two revolutions of the fuser roll, for example, the fluid delivery rate may reach a steady state. After the release fluid delivery or metering rate passes the transient states and has reached a steady state, the fuser roll and sheet is more likely receive to appropriate release fluid coverage. The fuser roll may define a fusing nip with a backing member such as a pressure roll. The sheet may be fused at the nip, and with appropriate release fluid coverage, may be separated form the fuser roll at the nip exit without deleterious effects on the image or degradative effects on system components.

The release fluid delivery system may be any suitable release fluid delivery system capable of delivering release fluid to a fuser apparatus and adjusting a delivery rate of the release fluid. For example, a delivery system may include a source of release fluid, a metering roll that contacts the source fluid, variable speed drive arranged to effect movement of the metering roll in an endless path at different surface velocities. The system may include a donor roll supported in contact with a fluid film metering roll. The donor roll may be configured to meter release fluid onto the metering roll, which meters the release fluid onto a surface of a fuser member such as fuser roll at various speeds depending on a surface velocity of the metering roll, and an amount of fluid film left on the donor roll, a film thickness on the metering roll, and/or a speed ratio between the metering roll and the donor roll.

The variable speed drive may be operably connected to a controller, which may be configured to control the speed of release fluid delivery according to, for example, user input on demand, sensor feedback indicative of fluid coverage or film thickness, and/or actual fluid delivery rate, and/or a predetermined fluid delivery rates that correspond to specific media types. The controller may be configured to adjust a release fluid delivery rate for specific media types during a print job according to predetermined fluid delivery rates known to be effective for each of the different specific media types, respectively. The fluid delivery rates may be stored in memory. For example, the rates may be stored in a look-up table that is configured to be in communication with the controller.

A print job may include, for example, printing on typical paper sheet media on which ink images are to be fused, and front and back covers, which may of a thicker media type. The portion of the print job including paper sheet media may require a high release fluid delivery rate, while the portion of the job including thicker and/or heavier media may require a lower release fluid delivery rate. Alternatively, in a print job for printing a covered book, the covers may be the same media type as the body sheets, and the covers may require less oil for high adhesion of book binding materials.

FIG. 1 shows a release fluid delivery rate adjustment control system in accordance with an embodiment. Fluid delivery system 100 includes a release fluid source such as a reservoir 110. The reservoir 110 may contain release fluid 115, such as silicone oil, or any other appropriate release agent and/or fluid.

The system 100 may include a meter roll 120 that is configured to pick up and carry release fluid on its surface. The meter roll 120 may be associated with a doctor blade 125 for cleaning the meter roll 120 after transfer of release fluid to other release fluid delivery system components. A variable speed drive may be connected to the meter roll 120 for controlling a speed of rotation of the donor roll, thereby controlling a rate of transferring release fluid from the meter roll 120 to the donor roll 140. The system shown in FIG. 1 is configured so that a release fluid delivery rate of fluid transfer from the meter roll 120 to the donor roll 140 is directly proportional to a release fluid delivery rate of fluid transfer from the donor roll 140 to a fuser member of an associated fusing system. A controller 135 may be operably connected to the variable speed drive to control operation thereof. Whether in response to user input, or in accordance with computer readable instructions stored, for example, in a memory device, the controller 135 may adjust the speed of the meter roll 120 by way of the variable speed drive 130 to thereby adjust a rate of fluid delivery onto a fuser member surface.

The system 100 may include a donor roll 140. The donor roll 140 may be arranged to contact the meter roll 120. As the meter roll 120 rotates and thus drives opposing rotation of the donor roll 140, release fluid carried on a surface of the meter roll 120 may be transferred to a surface of the donor roll 140. The donor roll 140 may be arranged to contact a fuser roll 150 of a fusing apparatus.

The fuser roll 150 may define a fusing nip 160 with a backing member such as a pressure roll 170. As the donor roll 140 rotates, release fluid that has been transferred to a surface of the donor roll 140 is delivered to a surface of the fuser roll 150. The release fluid is delivered to the surface of the fuser roll 150 at a predetermined rate to form a release fluid film of appropriate thickness that is suitable for fusing a sheet of a specific media type at the fusing nip, providing adequate release capability and image quality. A release fluid delivery rate may defined in terms of a volume of oil per sheet at the fusing nip. For example, the release fluid delivery system 100 may be configured to adjust a fluid delivery rate to a value in a range of about 1 to about 15 microliters per sheet. A sensor 175 may arranged adjacent to the fuser roll 150 to measure a film thickness on a surface thereof. Alternatively, other methods of determining film thickness and/or a current or actual fluid delivery rate may be implemented.

Figure 2:
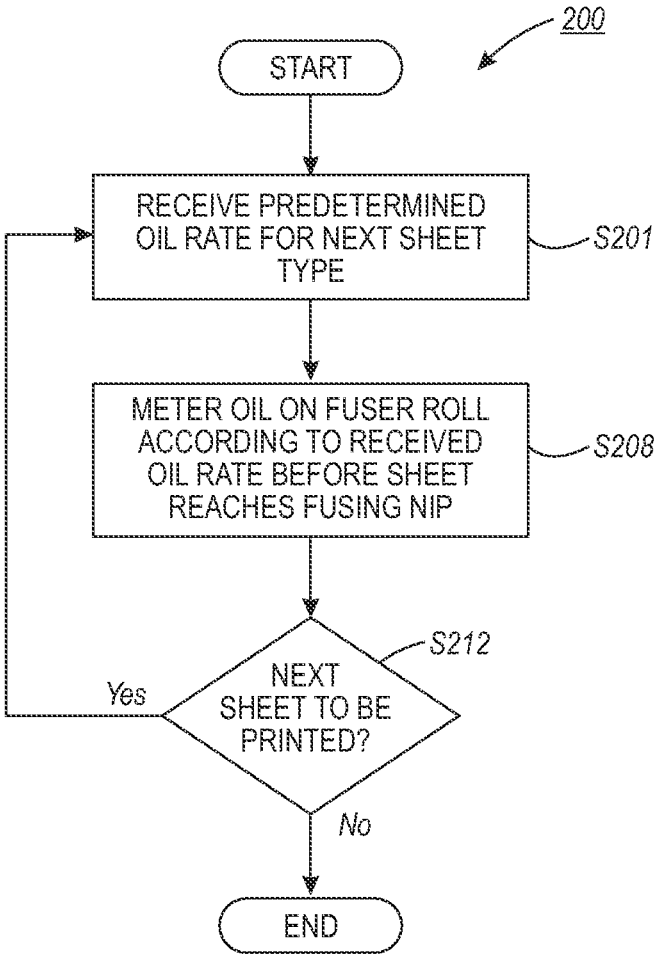
FIG. 2 shows a process for establishing a fluid release rate corresponding to a next sheet to be fused in accordance with an exemplary embodiment.

FIG. 2 shows methods in accordance with an embodiment. Methods may be carried our by, for example, the system shown in FIG. 1. A controller may be configured to control a release fluid delivery rate onto a fuser member in accordance with methods as shown in FIG. 2. For example, a controller may adjust release fluid delivery rates for a print job according to a user input instruction, such as when a user inputs a specific target rate at which to delivery release fluid such as silicone oil. Alternatively, rates may be predetermined and stored in a memory device. The rate may be predetermined to be appropriate and effective for fusing a sheet of a particular media type. The controller may be configured to adjust the release fluid delivery rate to a target rate before a sheet for which the rate is adjusted reaches a fusing nip to which the release fluid is delivered.

A controller may be configured to adjust an oil rate, for example, in accordance with a preset schedule wherein a print job that requires fusing sheets of different media types is predetermined to require different oil rates per different media types or sheet position within the print job. The controller may be configured to control a speed of fluid application to a fusing system according to the preset schedule, before a next sheet of a corresponding media type arrives at a fusing nip that is serviced by the controlled fluid release system.

The controller may be configured to receive data such as fluid delivery rates, which may stored in memory. For example, optimum fluid delivery rates and corresponding media types may be stored in a look-up table. Whether in response to media type sensor data, or predetermined and/or scheduled print job data, the controller may be configured to control fluid release from a fluid delivery system to adjust the fluid delivery rate in anticipation of an approaching sheet of a particular media type.

For example, FIG. 2 shows methods including receiving at S201 a predetermined oil rate for a next sheet type, or a next sheet of a particular media type to be fused at a fusing nip. A controller may be configured to meter oil onto a fuser roll that defines the nip according to the received oil rate at S208. Methods include determining at S212 whether a next sheet will be fused at the fusing nip. If so, methods may include receiving a predetermined oil rate for the next sheet type at S201, and repeating S208-S201 as necessary. By way of example, a fluid delivery system in accordance with methods and systems may include a controller that is configured to execute computer readable instructions that correspond to the process 200 shown in FIG. 2.

Figure 3:
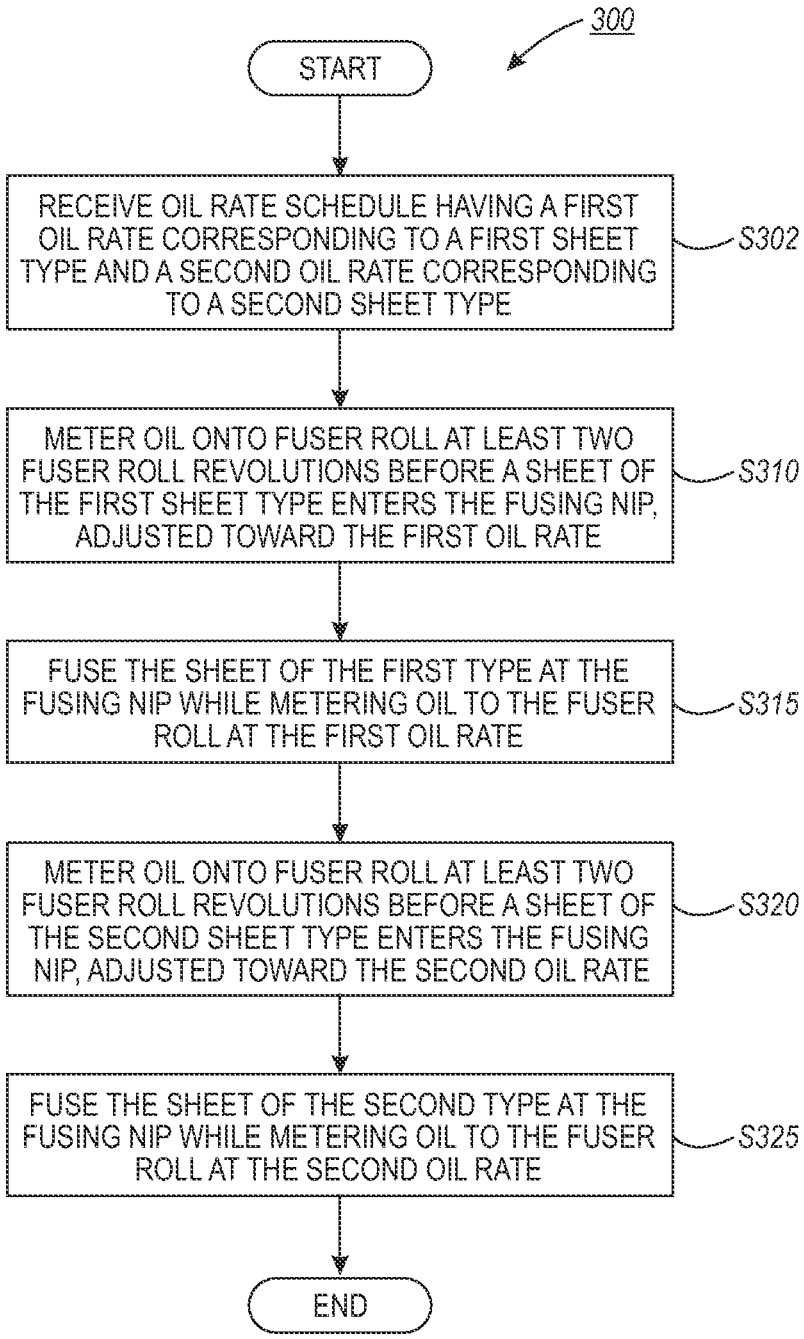
FIG. 3 shows a process for release fluid delivery and fusing in accordance with an exemplary embodiment.

FIG. 3 shows a process including methods in accordance with an embodiment. The process 300 shown in FIG. 3 includes receiving at S302 an oil rate schedule having a first oil rate corresponding to a first sheet type and a second oil rate corresponding to a second sheet type. The schedule may be input by a user, and/or or stored in memory.

At S310, the oil may be metered onto a fuser roll at a first oil rate at least two fuser roll revolutions before a sheet of the first sheet type enters the fusing nip. After two revolutions, the oil rate should arrive at a steady state so that the rate is not transient as the sheet enters the fusing nip, and adequate fluid coverage of the fuser roll and sheet may be achieved. At S315, the sheet of the first type may be fused at the fusing nip while metering oil to the fuser roll at the first oil rate, the oil rate having arrived at a steady state. Depending on system component characteristics, the amount of revolutions required for an oil rate to pass a transient state to arrive a steady state may vary.

At S320, oil may be metered at the second rate onto the fuser roll at least two fuser revolutions before a sheet of a second type enters the fusing nip so that the actual oil rate is at steady state corresponding to the second oil rate when the second sheet is fused at the fusing nip at S325.

Figure 4:
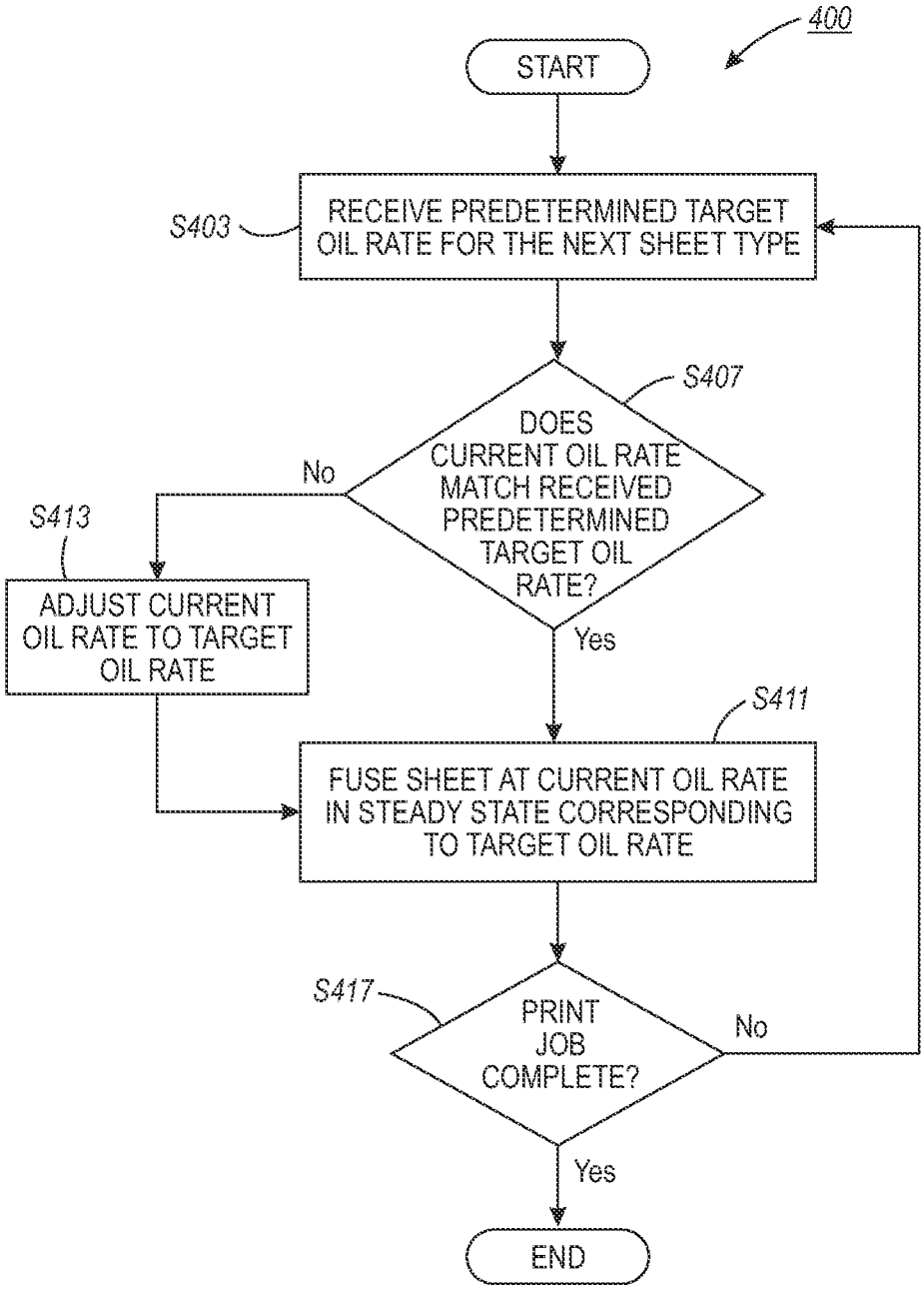
FIG. 4 shows a process for adjusting a fluid release rate corresponding to a next sheet to be fused in accordance with an exemplary embodiment.

FIG. 4 shows a process including methods in accordance with an embodiment. The process 400 shown in FIG. 4 includes receiving a predetermined target oil rate for a next sheet type in a print job at S403. Methods may include determining at S407 whether a current or actual delivery fluid release rate, e.g., oil rate, matches the received predetermined oil rate. For example, a system may be configured to adjust an actual oil rate toward the target oil rate, but the adjustment is not instantaneous. Alternatively, if the current oil rate already matches the target rate, then no adjustment may be needed. If the current oil rate does not match the received target oil rate, then the oil rate may be adjusted toward the target oil rate at S413. For example, a controller may be configured to adjust a speed of a connected donor roll of a fluid delivery system such as that shown in FIG. 1 to thereby adjust a speed of fluid delivery to a fuser roll from a metering roll. Adjustment to the target rate is not instantaneous, and progresses through a transient rate state until arriving at a steady state corresponding to the target oil rate.

After adjusting the oil rate at S413, in an alternative embodiment, S407 may be repeated to determine whether the current oil rate matches the target oil rate. As shown in FIG. 4, after the oil rate is adjusted to a target rate at S413, and after the oil rate at the fuser roll has reached a steady state, the sheet may be processed at the fusing nip whereby, for example, an ink image is fused to the sheet at S411 while delivering oil to the fuser roll of the nip at the current oil rate in steady state corresponding to the target oil rate. In systems, a controller may be configured to carry out methods as disclosed in accordance with algorithms in the form of computer-readable instructions.

While methods and systems for providing an anticipatory release fluid delivery rate for fusing particular sheets at an optimum fluid delivery rate are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for establishing a steady-state fuser release fluid delivery rate for processing a sheet at a fusing nip, the steady-state fluid delivery rate being established before the sheet is fused at the fusing nip, the method comprising:

adjusting a current fluid delivery rate to match a target fluid delivery rate;

fusing the sheet at the fusing nip at the current fluid delivery rate matching the target fluid delivery rate; and metering the release fluid onto the fuser member at least two fuser member revolutions before the first sheet enters the fusing nip.

2. The method of claim 1, comprising:

receiving a predetermined target release fluid delivery rate for a first sheet.

3. The method of claim 1, comprising:

determining whether the current fluid delivery rate matches the target fluid delivery rate.

4. A method for establishing a steady-state fuser release fluid delivery rate for processing a sheet a fusing nip, the steady-state fluid delivery rate being established before the sheet is fused at the fusing nip, the method comprising:

metering a release fluid onto a fuser roll according to a predetermined fluid delivery rate before a sheet enters the fusing nip; and metering the release fluid onto the fuser member at least two fuser member revolutions before the first sheet enters the fusing nip.

5. The method of claim 4, comprising:

receiving the predetermined release fluid delivery rate, the predetermined release fluid delivery rate corresponding to the sheet.

6. The method of claim 5, the predetermined release fluid delivery rate being stored as data in a look-up table format, the data including predetermined release fluid delivery rates and corresponding sheet types.

7. A method for establishing a steady-state fuser release fluid delivery rate for processing sheets a fusing nip for a print job, the method comprising:

metering release fluid onto a fuser member at a first release fluid delivery rate before a first sheet is contacted by the fuser member; and metering the release fluid onto the fuser member at least two fuser member revolutions before the first sheet enters the fusing nip.

8. The method of claim 7, comprising:

fusing the first sheet at the fusing nip while metering release fluid onto the fuser member at the first rate.

9. The method of claim 7, comprising:

fusing the second sheet at the fusing nip while metering release fluid onto the fuser member at the second release fluid rate.

10. The method of claim 7, comprising:

metering release fluid onto a fuser member at a second release fluid delivery rate before a second sheet is contacted by the fuser member.

11. The method of claim 10, comprising:

receiving a first release fluid delivery rate corresponding to a first sheet type; and receiving a second release fluid delivery rate corresponding to a second sheet type.

12. The method of claim 11, wherein the first rate and the second rate are stored in a relational database, wherein the first rate is a predetermined rate that corresponds to the first sheet type, and the second rate is a predetermined rate that corresponds to a second sheet type.

13. The method of claim 12, wherein the first sheet is a first sheet type and the second sheet is a second sheet type.

14. The method of claim 13, wherein the first sheet type is paper having at least one of a first weight, a first thickness, and a first coating, and the second sheet type is paper having at least one of a second weight, a second thickness, and a second coating.

15. The method of claim 14, wherein the release fluid is silicone oil.

16. A system for establishing a steady state release fluid delivery rate for delivering fluid from a release fluid delivery system to a fuser member, the system comprising:

a release fluid delivery system for delivering release fluid to a fuser member, a rate of fluid delivery from the delivery system to the fuser member being adjustable; and a controller for adjusting the rate of fluid delivery to a predetermined rate, the predetermined rate corresponding to a next sheet to be contacted by the fusing member, the controller adjusting the rate to the predetermined rate before the sheet is contacted by the fuser member, wherein the release fluid is metered onto the fuser member at least two fuser member revolutions before the first sheet enters the fusing nip.

* * * * *